US008900683B2

(12) United States Patent
Debnam

(10) Patent No.: US 8,900,683 B2
(45) Date of Patent: Dec. 2, 2014

(54) RAPID ACCESS FIRE BARRIER PANEL SYSTEM

(71) Applicant: Peter Debnam, Granton (AU)

(72) Inventor: Peter Debnam, Granton (AU)

( * ) Notice: Subject to any disclaimer, the term of this patent is extended or adjusted under 35 U.S.C. 154(b) by 444 days.

(21) Appl. No.: 13/626,655

(22) Filed: Sep. 25, 2012

(65) Prior Publication Data

US 2014/0113102 A1 Apr. 24, 2014

(51) Int. Cl.
*B63B 3/68* (2006.01)
*B63B 11/04* (2006.01)

(52) U.S. Cl.
CPC ..... *B63B 11/04* (2013.01)
USPC ..... 428/45; 114/116

(58) Field of Classification Search
CPC ..... B63B 3/68; E04B 1/942; E04B 1/944
USPC ..... 428/45; 114/116
See application file for complete search history.

(56) References Cited

U.S. PATENT DOCUMENTS 8,375,670 B2 * 2/2013 Hysky ..... 52/506.06

* cited by examiner

*Primary Examiner* — Alexander Thomas
(74) *Attorney, Agent, or Firm* — John R. Ross; John R. Ross, III

(57) ABSTRACT

A rapid access fire protection panel system for applications requiring fire protection against severe fire situations. The system is a panel system that can be rapidly installed and rapidly removed for periodic maintenance or inspection. The panel system includes a special expandable insulation. A first preferred embodiment of the present invention includes: insulated sub-frame channels, corner support brackets, intermediate clips, insulated panels including a rigidized metal outer layer, cover strips, cover plates, insulated light panels and cable gland recess penetrations. A preferred embodiment of the present invention is specifically designed to meet the N-30 requirements of the United States Navy.

14 Claims, 13 Drawing Sheets

FIG. 1C
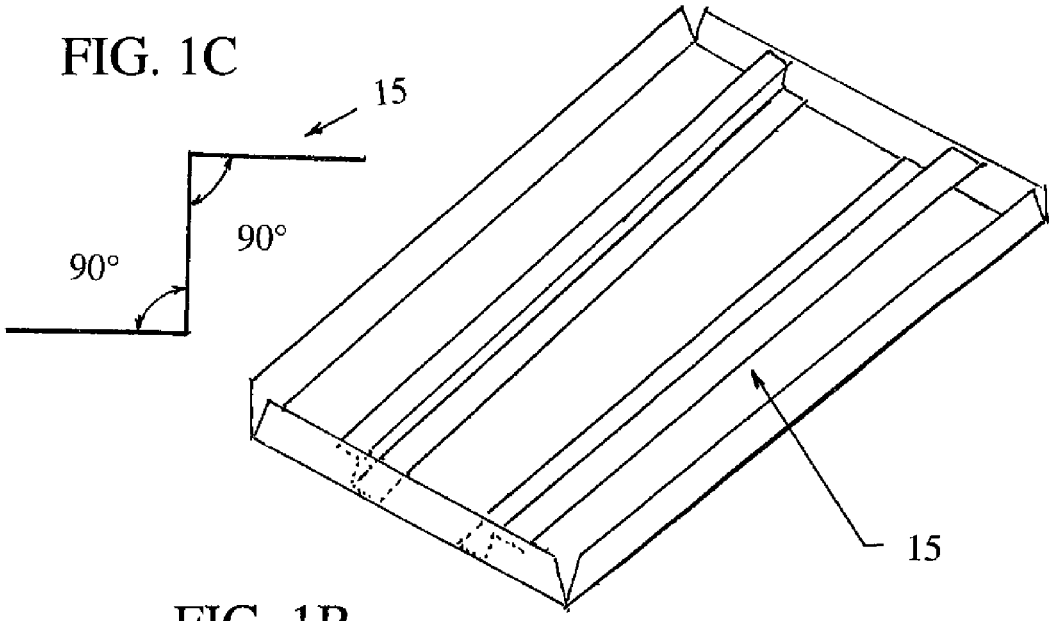
FIG. 1B
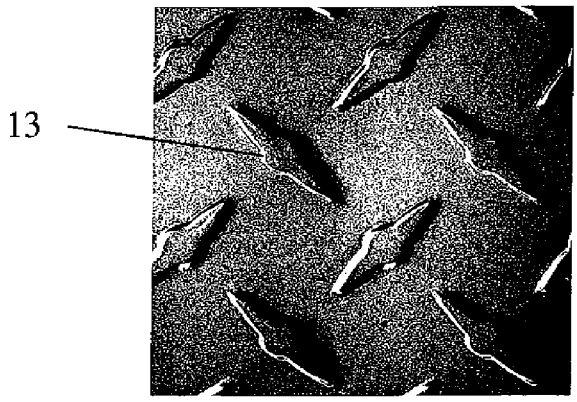
FIG. 1A

CBG N30 SUBFRAME CHANNEL

CBG N30 CORNER SUPPORT BRACKET

CBG N30 INTERMEDIATE CLIP

SECTION A-A

SECTION C-C

CBG N30 COVER STRIP

CBG N30 INSULATED LIGHT PANEL
note - insulation not shown for clarity

CBG N30 AFF SPRINKLER RECESS
note - sprinkler not shown

CBG N30 INSULATED PANEL
note - internal stiffeners and insulation pins not shown

RAPID ACCESS FIRE BARRIER PANEL SYSTEM

CROSS REFERENCE TO RELATED APPLICATIONS

This application claims the benefit of provisional patent application Ser. No. 61/626,655 filed Sep. 30, 2011 by the present inventor.

FIELD OF THE INVENTION

The present invention relates to fire insulation systems and in particular to fire insulation systems utilizing multiple panels to provide fire barriers.

BACKGROUND OF THE INVENTION

The International Maritime Organization (IMO), the United Nations specialized agency responsible for ship safety, has adopted the International Convention for Safety of Life at Sea (SOLAS), the international maritime safety treaty for the convention of safety of life at sea. This convention covers a wide range of applications, which includes fire resistance of bulkheads and deck heads, which is of critical importance to safety at sea. The recommendations for fire resistance tests are detailed in IMO Resolution A. 754(18), Fire Resistance Tests, Fire Safety On Board Ships. These tests subject fire protection materials (test specimen), which are typically installed in front of a representation of a ships structure (structural core), to a heat release rate which is representative of a cellulose material fire. This cellulosic time/temperature curve is described in the International Organization for Standardization standard, ISO 834. Temperature measurements are taken on the structure core and must satisfy the criteria detailed in Resolution A.754(18) in order to qualify the fire protection material as a fire resisting division. The design and safety of high-speed craft is regulated by the High Speed Craft Codes of 1994 and 2000, adopted by the Maritime Safety Committee of the IMO.

CBG Systems Pty Ltd, with offices in Tasmania, Australia, specializes in the design, development, manufacture and installation of panelized marine structural fire protection systems. CBG has commercialized three unique systems, two for SOLAS ships, and one for High Speed Craft. CBG markets an A-60 class structural fire protection system for fire insulation of deckheads and bulkheads. This prior art system is referred to as its RAS® system. Unlike conventional insulation RAS® is a panel system typically mounted on stiffeners 300 mm below deckheads and 500 mm from bulkheads on the stiffener side of the bulkhead. The standard size of the panels is 1200 mm×900 mm. The panels are mounted in a grid support structure that can be installed in a shipyard at a rate of about 3.5 hours per square meter. This system greatly reduces maintenance costs as compared to conventional surface mounted wrap insulation. Panels can be removed and replaced by one person in less than 5 minutes per panel by way of quarter turn corner plates and screwed on cover strips. All components are 316 stainless steel and do not require secondary corrosion protection. The RAS® system meets IMO requirements as an A-60 Class fire division for steel and aluminum vessel construction.

Although the cellulosic fire curve has generally been accepted as an appropriate test method for many years, it became apparent that certain materials such as petrol, gas or chemicals, have a burning heat release rate well in excess of cellulosic materials such as timber. A time/temperature curve was developed to represent the heat release rate of a hydrocarbon pool fire, and is described in UL 1709 established by Underwriters Laboratories.

The US Navy has developed a unique standard of fire resistance for their surface ships, initially described in MIL-PRF-32161, with revised fire resistance test methods described in MIL-STD-3020. This standard includes the more severe UL 1709 time/temperature curve, and also a requirement for shock testing. This shock testing is designed to be representative of the shock which may be experienced by a ship in operational conditions e.g. missile/mine hit. The shock test methods are described in the Navy Military Specification, MIL-S-901D.

One particular standard of US Navy fire resistance, which is commonly utilized on US Navy surface ships, is "N-30". This standard involves shock testing of 4 foot×10 foot specimen, fire testing of the shocked and a non-shocked 4 foot×10 foot specimen, and then "full-scale" fire testing of a 12 foot×13.5 foot specimen.

What is needed is an easy to install and remove panel type fire protection system that will meet the requirements of N-30 for use by the US Navy and in other applications requiring protection against severe fire situations.

SUMMARY OF THE INVENTION

The present invention provides a rapid access fire protection panel system for applications requiring fire protection against severe fire situations. The system is a panel system that can be rapidly installed and rapidly removed for periodic maintenance or inspection. The panel system includes a special expandable insulation. Preferred embodiments of the present invention are specifically designed to meet the N-30 requirements and are referred to by Applicants as the CBG N-30 Panel System (or "CBG N-30 PS"). This invention is based on an existing CBG design, "Rapid Access Stainless" (RAS); however, many other important improvements differentiate this invention from all prior art fire protection systems.

Preferred embodiments are comprises of:

A plurality of standard sized panels adapted for rapid installation and rapid removal for periodic maintenance or inspection. Each of the panels include: a rigidized metal outer layer comprising a plurality of dimples designed to absorb effects of thermal expansion resulting from extreme heat in order to avoid warping or crumpling of the metal outer layer, a first high density insulation layer, a second layer of insulation having density of less than one half the density of the first layer, a reflector layer positioned between the first layer and the second layer and a protective cover layer covering the second layer of insulation.

A stand-off rectangular grid is solidly connected to a ship structure. The grid is formed of insulated sub-frame channel elements configured to support the standard sized panels. The sub-frame channel elements are comprised of a generally u-shaped metal channel having within the channel a first channel insulation layer and a second insulation layer within the channel but covering the first insulation layer. The second insulation layer is a high-density insulation and is expandable by at least a factor of four with the application of heat from a hydrocarbon fire. The preferred embodiments also include corner support brackets mounted on said stand-off rectangular grid and adapted to temporarily hold in place said standard sized panels during installation of the panels said corner support brackets being comprised of a locking tab and a locking disk. Also included are generally T-shaped cover strips defining a flange adapted to trap the panels between the flanges of said T-shaped cover strips and the insulated subframe channels. The system further includes a large number of intermediate clips solidly attached at intermediate positions on said sub-frame channel elements at positions so as to identify locations for screw mounting said T-shaped cover strips and a number of cover plates adapted to be screw mounted on said corner support brackets to cover gaps at intersections of said T-shaped cover strips.

Systems in accordance with the present invention meet the requirements of the US Navy's N-30 standard and can be utilized in many other applications requiring fire protection against severe fire situations. Important improvements over CBG's prior art structural fire protection systems include:

1) Each panels of the present invention now include a stainless steel rigidized panel pan modified to expand within itself when subjected to very high temperatures to avoid or greatly reduce warping or crumpling.
2) Each of the panels also includes a composite of insulation, foil and coated fiberglass to provide thermal resistance.
3) Panel insulation now includes two layers of special blanket insulation free of phenol formaldehyde resin.
4) Special cover strips for the panels are based on a new design to avoid panel "popping out" in the event of a shock event.
5) The system includes specially designed sub-frame channel elements used to construct a stand-off grid on which the insulated panels are mounted. The sub-frame channel elements are insulated with a special insulation that expands as much as 9 times its normal volume in the event of fire.

Actual tests have proven that systems constructed in accordance with the present invention meet the requirements of the US Navy's N-30 fire protection and shock standards.

BRIEF DESCRIPTION OF THE DRAWINGS

FIG. 1A shows an enlarged view of the propeller-shaped dimples.

FIG. 1B shows the Z-shaped stiffeners.

FIG. 1C shows a Z-section stiffener

DETAILED DESCRIPTION OF PREFERRED EMBODIMENTS

Preferred embodiments of the present invention are now described in detail with reference to the drawings.

CBG N-30 Panel System

Figure 1:
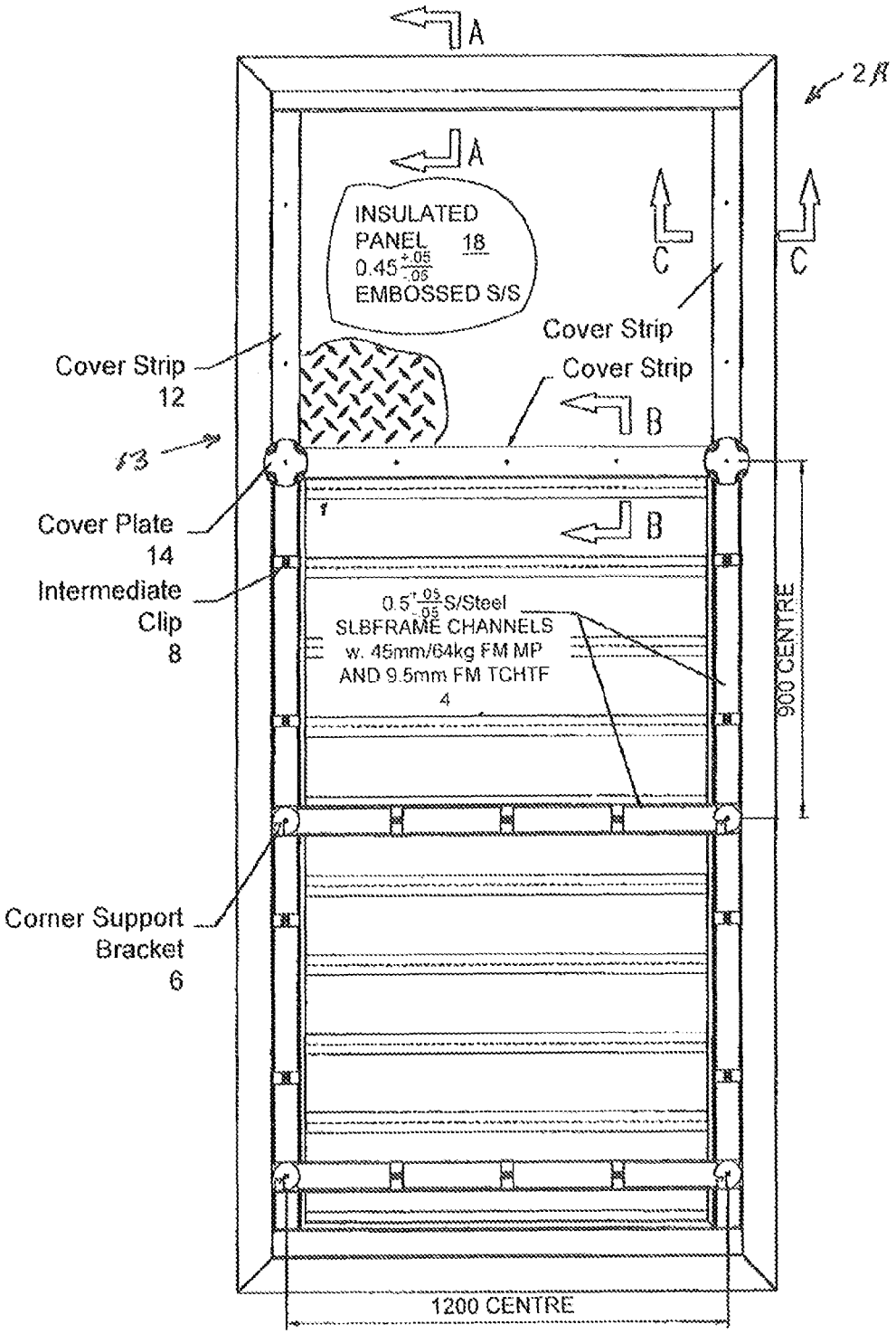
FIG. 1 is a partially cut-away view of a CBG N-30 PS for a deckhead (ceiling) installation as viewed from below.
Figure 2:
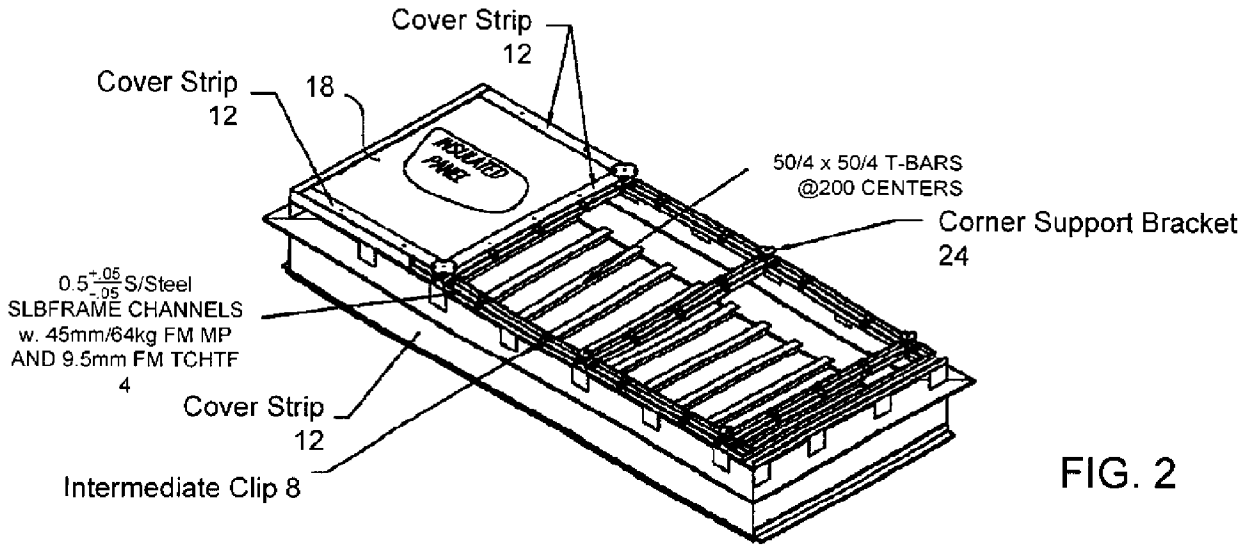
FIG. 2 is an isometric view of the same panel system.

FIGS. 1-14 are drawings describing a preferred embodiment of the present invention referred to by the Applicants as their "CBG N-30 Panel System". Like the RAS® system discussed in the Background section, panels in accord with the present invention are preferable mounted on a grid structure about 300 mm below deckheads and about 500 mm from bulkheads on the stiffener side of the bulkhead. This grid support structure can be installed in a shipyard at a rate of about 3.5 hours per square meter. This system like the RAS® system greatly reduces maintenance costs as compared to conventional surface mounted wrap insulation. Panels can be removed and replaced by one person in less than 5 minutes per panel by way of quarter turn corner plates and screwed on cover strips. All components are 316 stainless steel and do not require secondary corrosion protection. The standard size of the panels is 1200 mm×900 mm. FIG. 1 is a partially cut-away view of a CBG N-30 panel system 2 for a ceiling installation as viewed from below. The panel system includes: insulated sub-frame channel 4, corner support brackets 6, intermediate clips 8, insulated panels 18, cover strips 12 and cover plates 14. These features are also shown in FIG. 2 which is an isometric drawing of panel system 2. As shown in FIGS. 1 and 2, a portion 2A of panel system 2 includes spaces for the insertion of three insulated panels 18.

Insulated Sub-Frame Channel

Figure 3:
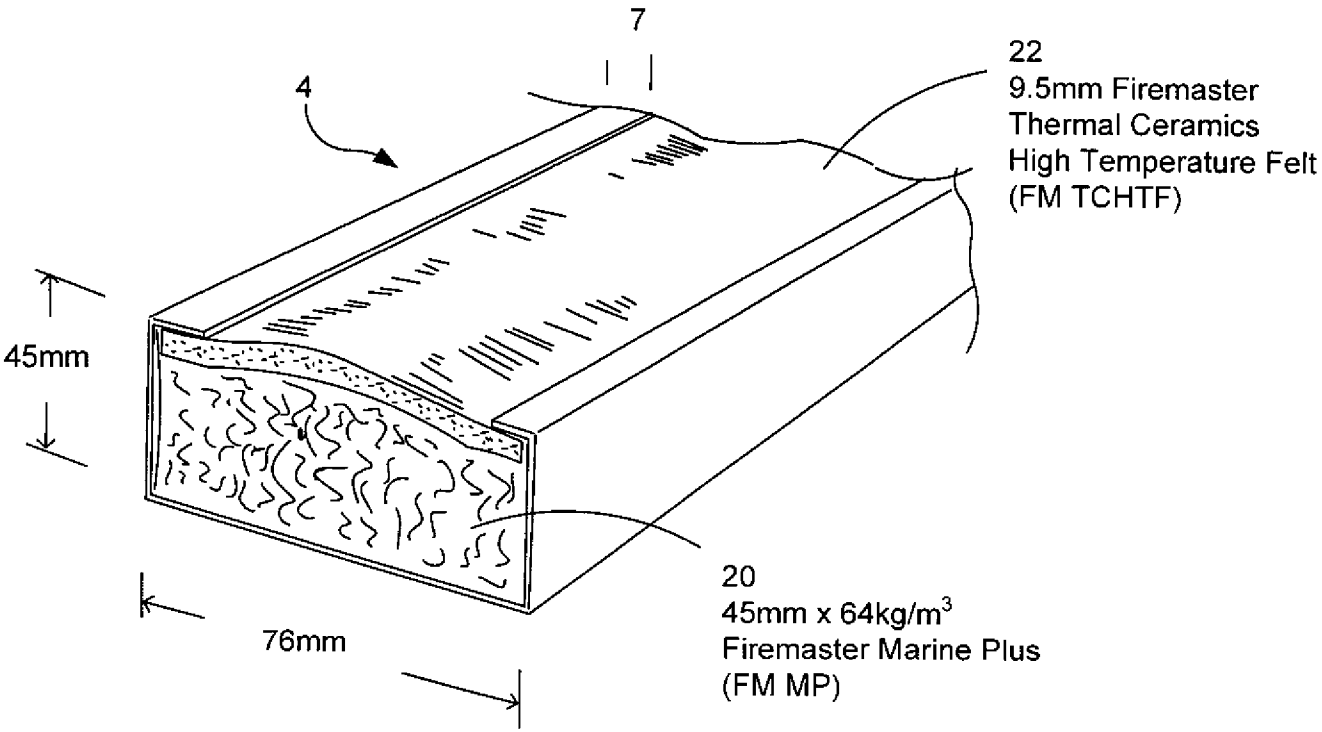
FIG. 3 is a sketch of an insulated sub-frame channel.

A sketch of an insulated sub-frame channel 4 needed for the construction of a grid for mounting the panels is shown in FIG. 3. The insulated sub-frame channels are constructed from 0.5±0.05 mm stainless steel, flat pieces of stainless steel are inserted into a roll forming machine, which uses staged rollers to form the profile of the channel with the dimensions shown in FIG. 3. The channels can be formed in any length, and is dependent on installation requirements and transport logistics. The channel is insulated along its entire length with 45 mm thick, 64 kg/m$^3$ density Thermal Ceramics Marine Plus (TC MP) blanket insulation 20. The unique feature, not used in the RAS™ system, of the channel is the addition of a layer of high temperature felt (Model TC HTF) 22 available from Thermal Ceramics, Inc with offices in Augusta, Ga. This material comprises alkaline-earth silicate wool, graphite, latex and fibrous glass. This felt exfoliates/expands to typically 9-10 times its original thickness (if unrestrained) upon the application of heat. The purpose of this felt is to expand and form a seal between the top of the channel and the panel insulation during a fire event.

Corner Support Brackets

Figure 4:
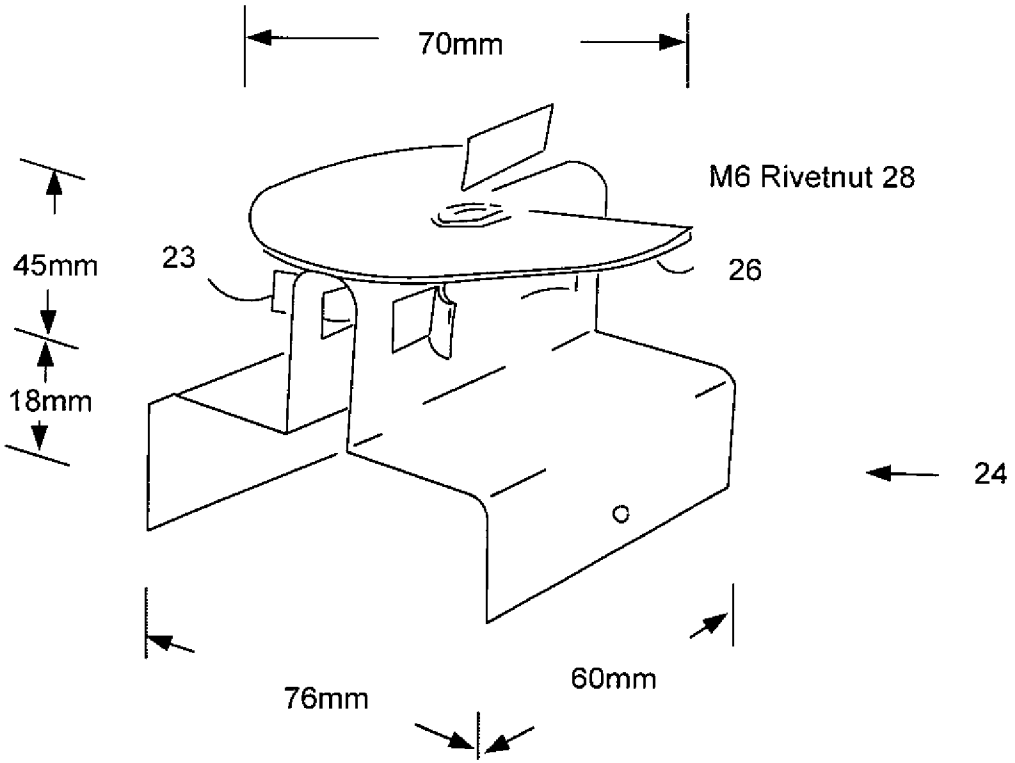
FIG. 4 is sketch of a corner support bracket.
Figure 14:
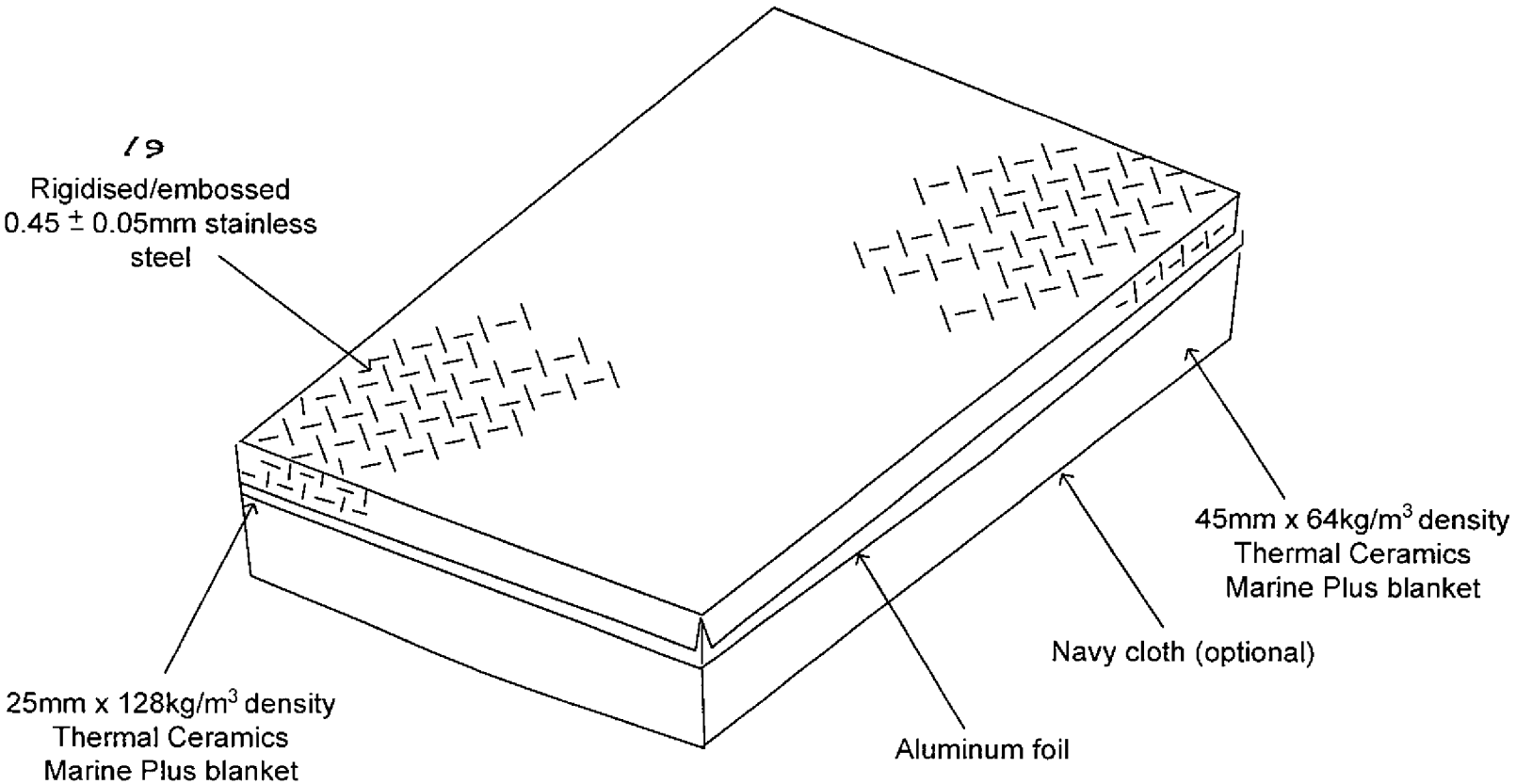
FIG. 14 is a sketch of an insulated panel

Corner support brackets 24 are shown in FIG. 2 and details are shown in the sketch of the corner support bracket in FIG. 4. The purpose of the corner support brackets is to hold the panels in place temporally during installation until the cover strips and corner supports can be installed to lock the panels securely in place. The corner support brackets are based on an existing CBG design from the RAS system. They are constructed from 0.9 mm stainless steel, whose base is formed by inserting a blank into a punch and die set which is installed in a press punch. The punch and die set punch out the basic shape of the corner support bracket, which is then moved to another stage on the die and formed into shape. The corner support brackets feature locating tabs 23 and a locking disc 26. The locating tabs go into the notches 15 in outer layer 19 as shown in FIG. 14 in each corner of the panels. The panel edges are folded up 90 degrees perpendicular, however since Applicants notch out each corner over square, i.e. about 120 degrees, when the panel edges are folded his creates a triangular shaped notch at the corner of each panel. The tabs fit into these notches, and as the panel goes farther in, the fit becomes tighter. The metal of the panel is flexible so there is good friction between the panel and the locating tabs. The locking disc has ¼ of its body removed, which when aligned correctly, allows the panels to be installed, and then turned to hold the panel in place temporarily, until the cover strips and corner cover plates are installed to permanently hold the panels in place. The locking disc is attached to the corner support bracket base with a threaded insert/rivet nut 28. This allows the locking disc to be turned to install or remove the panels. The threads in threaded rivet nut 28 permit a screw to be used to attach insulated cover plate 14 as described below and as shown in FIG. 1 to cover and insulate the corner support brackets.

Intermediate Clips

Figure 5:
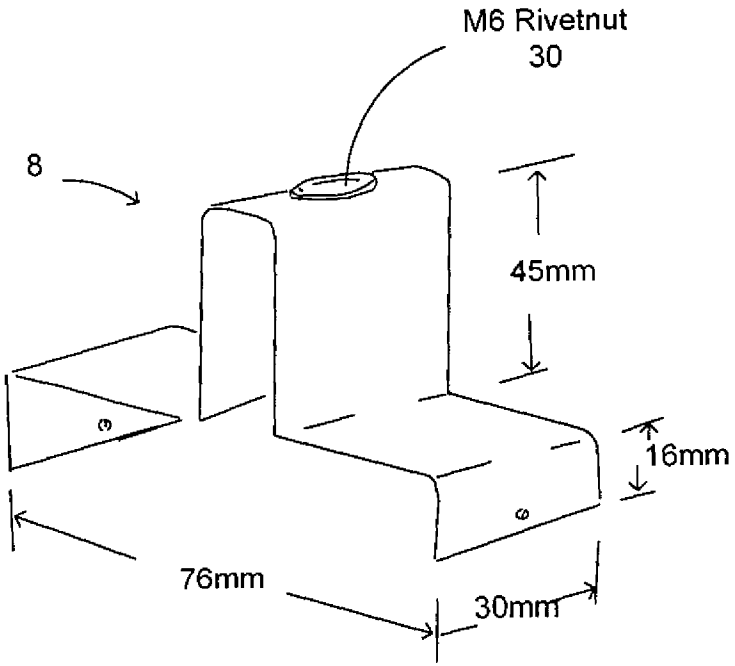
FIG. 5 is a sketch of an intermediate clip.

The intermediate clips 8 are also based on an existing CBG design from the RAS system. A sketch of the intermediate clip is shown in FIG. 5. They are constructed from 0.9 mm stainless steel, which are formed by inserting a blank into a punch and die set which is installed in a press punch. The punch and die set punch out the basic shape of the intermediate clip, which is then moved to another stage on the die and formed into shape. A threaded insert/rivet nut 30 is installed into the top of the intermediate clip, providing in each case a thread for a cover strip screw to be fastened into.

Insulated Panels

The insulated panels 18 shown in FIG. 14 are in general an improvement of the existing CBG design from its RAS system. A fundamental difference is the use of two layers of Thermal Ceramics Marine Plus blanket instead of one layer of Thermal Ceramics FireFelt 607 sheet. FireFelt 607 is not acceptable for US Navy use to due the presence of phenol formaldehyde resin, whereas this material is not present in the Marine Plus product.

Rigidized Metal Panel Pan

An important feature of the present invention is the rigidized stainless steel panel pan 19, as shown in FIG. 14. This is the portion of the insulating panel that would initially face the fire. It is constructed from 0.45±0.05 mm stainless steel, which is rigidized-embossed with about 200 propeller-shaped dimples as shown at 13 in FIG. 1 and in the expanded view in FIG. 1A. The dimples are about 25 millimeters long and about 3 millimeter deep. The central section of the dimples is roughly circular with a diameter of about 5 millimeters and the two arms of the dimples are each pointed and extend out about 10 millimeters from the central section. The dimples are preferably positioned along 25-millimeter centers in a crisscross pattern as shown at 13 in FIGS. 1 and 1A and aligned at about 45 degrees with the edges of the stainless steel panel pan. He dimples preferably are on the insulation side of the panel pan. In the event of a very hot hydrocarbon fire event the dimples will tend to close up relieving to an extent the stress in the stainless steel and preventing of minimizing warping of the cover layer. If a panel pan were to become warped or crumpled during a fire event, the seal between the panel face and cover strips is potentially compromised.

The coefficient of lineal expansion of 316 stainless steel is 15.9 um/m ° C. The largest dimension of the panels is 1.185 in and the temperature of a hydrocarbon fire could be 1097° C. above ambient. Therefore, expansion during such a fire would produce expansions of an unrestrained flat sheet of stainless steel of about 20 mm. Applicant's tests have shown that a flat stainless steel plate of these dimensions restrained at its edges crumples in such a hydrocarbon fire. If restrained this expansion would have the effect of warping or crumpling the panel face if no relief is engineered into panel. The impressions created during the rigidizing process allow the stainless steel to expand into itself, thus reducing or avoiding the warping or crumbling. Applicant has proved this in a test, that a plain panel simply crumpled and created a gap between the panel and cover strip. Heat was able to pass directly through this gap resulting in a test failure. With the rigidising of the metal with the dimples as described above and wider cover strips, Applicant and his fellow workers were able to pass the test.

This rigidizing can be performed by several methods, by either rolling the stainless steel blank through mechanical rollers along with a sheet of propeller plate and rubber, rolling the stainless steel blank through mechanical rollers with a male propeller plate profile on one roller and a female propeller plate on the other roller, or by pressing the stainless steel blank with male propeller plate die into a female propeller plate die.

Once the blank has been rigidized, it is then cut and folded either by hand or by a punch and die set in a press punch. Two 0.5±0.05 mm stainless steel Z-section stiffeners of dimensions 30×30×30 mm (as shown in FIG. 1C), with lengths equal to the lengths of the panels, are manufactured either by hand or by roll forming. These stiffeners 15 are spot welded on the inside of the panel, equidistant (about 300 mm) from the panel edge and the other stiffener. Three weld spots are provided for each Z-section, at the center of the Z and at both ends. Once the panel blank has been formed into shape 100 mm long insulation pins (not shown) are attached using a stud welding machine. These pins are installed at minimum 200 mm centers and are checked to ensure they are correctly welded to the panel.

Insulation Composite

Figure 8:
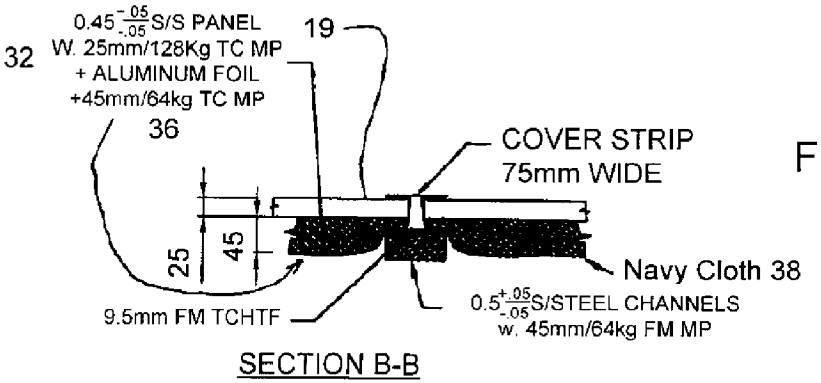
FIG. 8 is a section view (Section B-B) referring FIG. 1 and showing features of the preferred embodiment.
Figure 6:
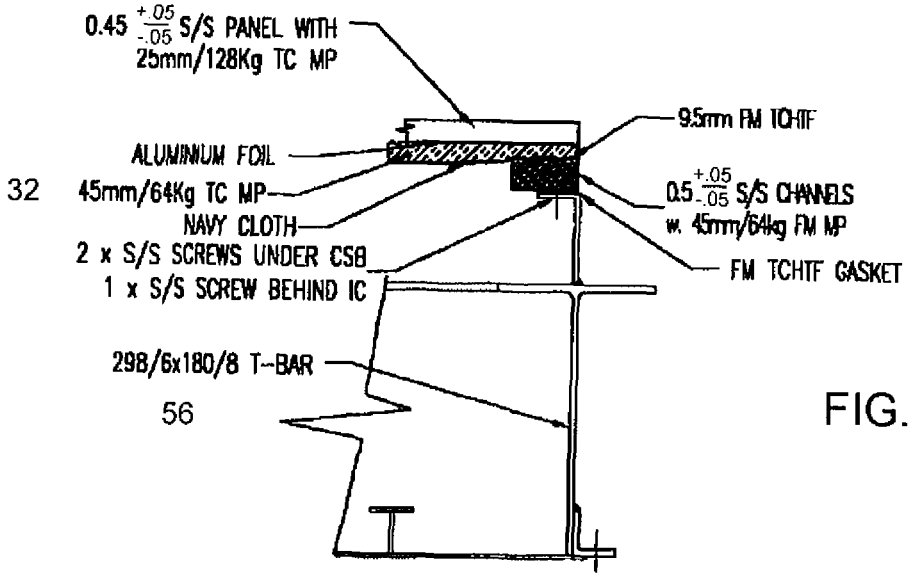
FIG. 6 is a section view (Section A-A) referring FIG. 1 and showing features of the preferred embodiment.

The panels utilize a composite of insulation, foil and coated fiberglass cloth as shown in FIGS. 8 and 14 to provide thermal resistance. This composite technique is unique to structural fire protection panels. One layer of 25 mm thick, 128 kg/m$^3$ density Thermal Ceramics Marine Plus blanket 32 shown on FIG. 14 is first impaled on the insulation pins. This relatively thin layer of high density insulation provides initial thermal resistance against the high temperatures experienced during a hydrocarbon fire event. A layer of aluminum foil 65 is then impaled onto the insulation pins, positioned so that the more reflective side of the foil is facing towards the stainless steel layer 19. This layer adds thermal resistance by reflecting heat away from the structural core 67 as shown in FIG. 6.

A final layer of 45 mm thick, 64 kg/m$^3$ density TC MP blanket 36 as shown in FIG. 14 is then installed on top of the foil. This relatively thick, low density insulation provides the thermal resistance for the lower level of heat which has conducted through the panel face, first layer of insulation and foil. Heat travels slower through a material which is thicker and lower density when compared to a thinner, higher density material of the same areal weight. During installation of the final layer of insulation, care is taken so that any joins in this layer are offset from any joins in the first layer, this ensures there is no direct patch for heat to travel through the panel.

A layer of coated leak proof fiberglass cloth 38 is then installed on top of the final layer of insulation. This cloth is preferably fiberglass cloth which has US Navy MIL-C-20079 Type I, Class 2 and IMO FTP Code Part 2 & Part 5 approvals. The cloth is adhered to the insulation with adhesive which is approved for use with the cloth. This cloth provides a vapour barrier for the panel system as well as preventing the ingress of liquid into the panel insulation.

Cover Strips

Figure 9:
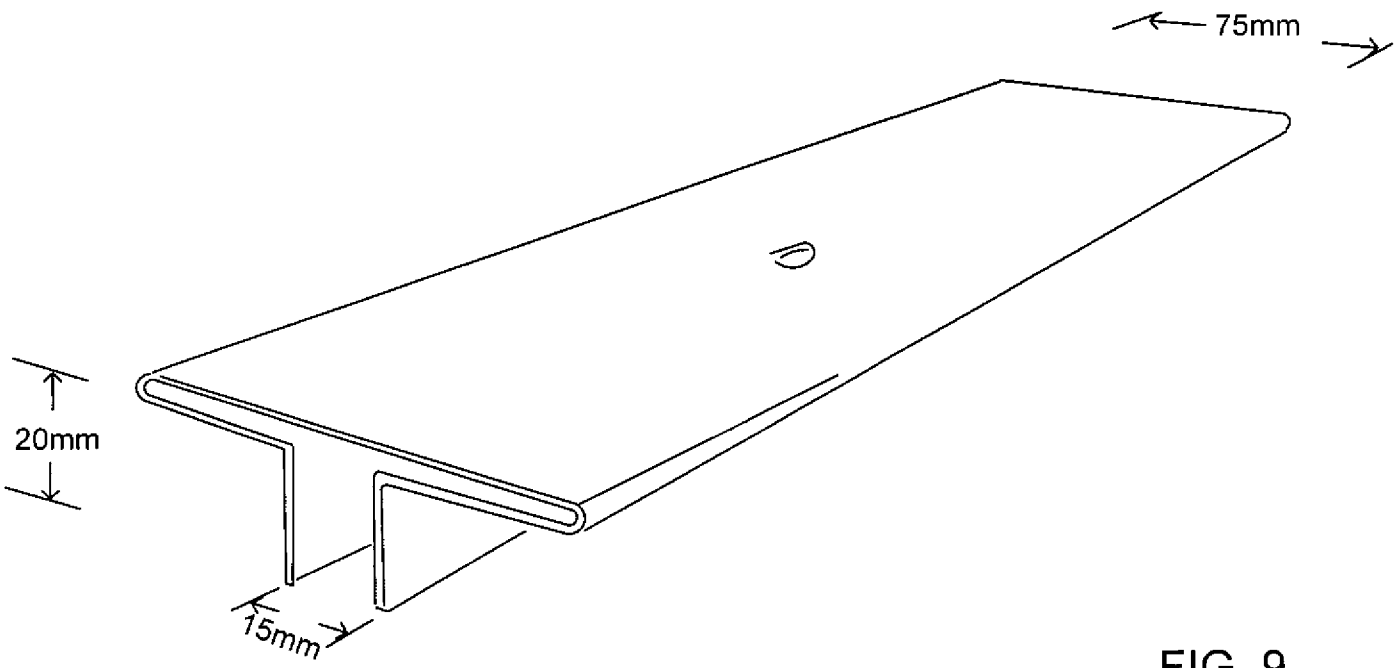
FIG. 9 is a sketch of a cover strip.

The cover strips 12 shown in FIG. 1 and FIG. 8 are also based on an existing CBG design from the RAS system; however, these strips feature a wider top flange which helps to reduce the warping of the cover strip, provides a wider sealing face between the panel and the flange of the cover strip, and holds the panel in place more securely to minimize the chance of the panel 'popping out' during a shock event. A sketch of a cover strip is shown in FIG. 9. The T-shaped cover strips are constructed from 0.45±0.05 mm stainless steel and can either be formed by hand in a brake press/pan brake, or by roll forming.

Cover Plates

Figure 10:
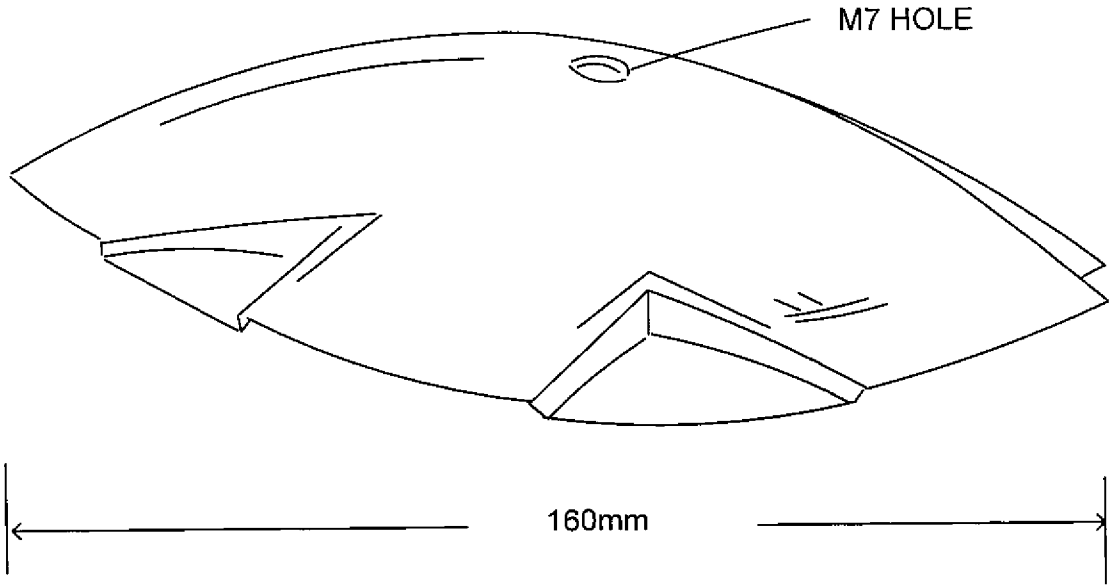
FIG. 10 is a sketch of a cover plate.

The cover plates 14 are based on an existing CBG design from the Rapid Access Composite (RAC) system. They are constructed from 0.45±0.05 mm stainless steel, which are formed by inserting a blank into a punch and die set which is installed in a press punch. A sketch of a cover plate is shown in FIG. 10. The cover plates are insulated with a piece of TC HTF.

Insulated Light Panel

In a typical fire protection panel system installation, there is usually a requirement for lighting to be installed on the face of the panels. At times, some of these lights are required to be recessed back into the panel system, usually to aid in overhead or side clearance.

Figure 11:
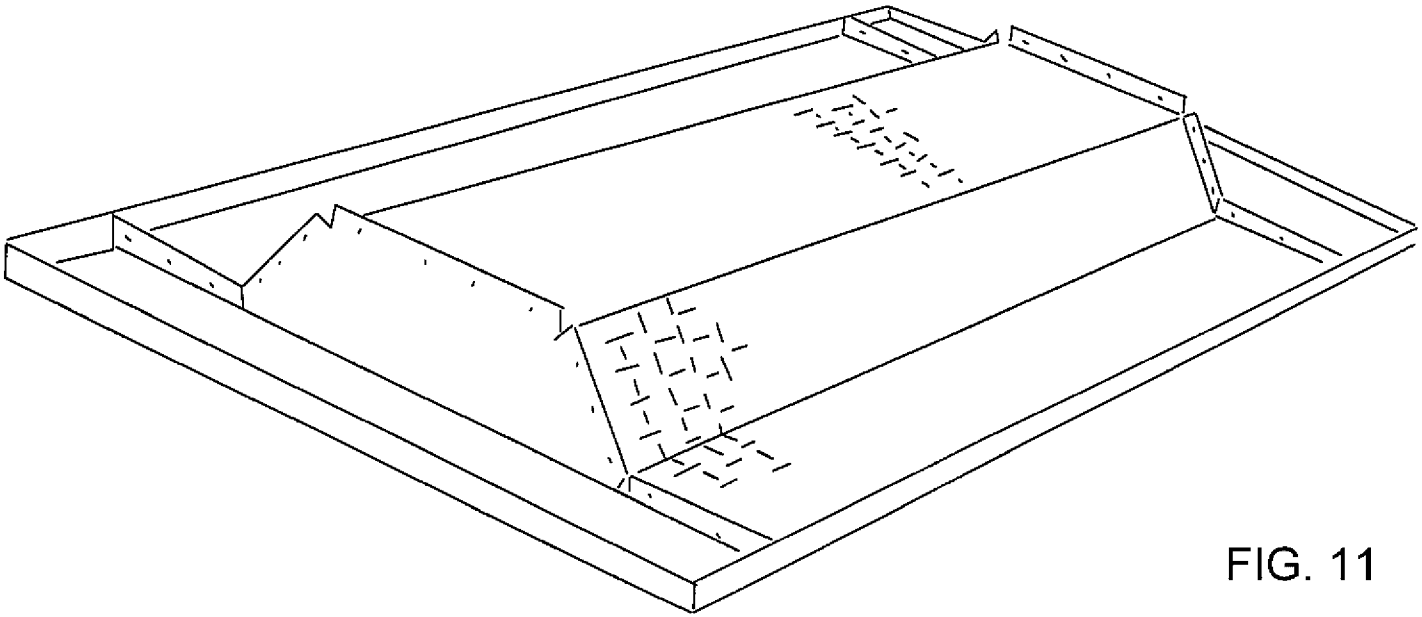
FIG. 11 is a sketch showing a light panel without its insulation.

The insulated light panel is constructed from the same materials as a standard insulated panel. The fundamental difference is the light panel features a recess where a fluorescent light fitting can be installed into. The panel is fabricated by hand in 3 sections, which are then spot welded together. Two 0.5±0.05 mm stainless steel L-section stiffeners of dimensions 30×30 mm are spot welded to the insulated panel along the longest edge. A sketch of a light panel is shown in FIG. 11. FIG. 11 shows a stainless steel outer layer 19A that has been fabricated to provide the recess region. This panel is otherwise substantially identical to the standard panels described above.

Cable Gland Recess Penetration

In a typical fire protection panel system installation, there is usually a requirement for a number of electrical cable penetrations, or possibly thin tubing for air conditioning or air control systems. Since these cables/tubes penetrate the panel system, devices called 'penetrations' need to be designed and installed, so that the fire resistance is not compromised.

Figure 12:
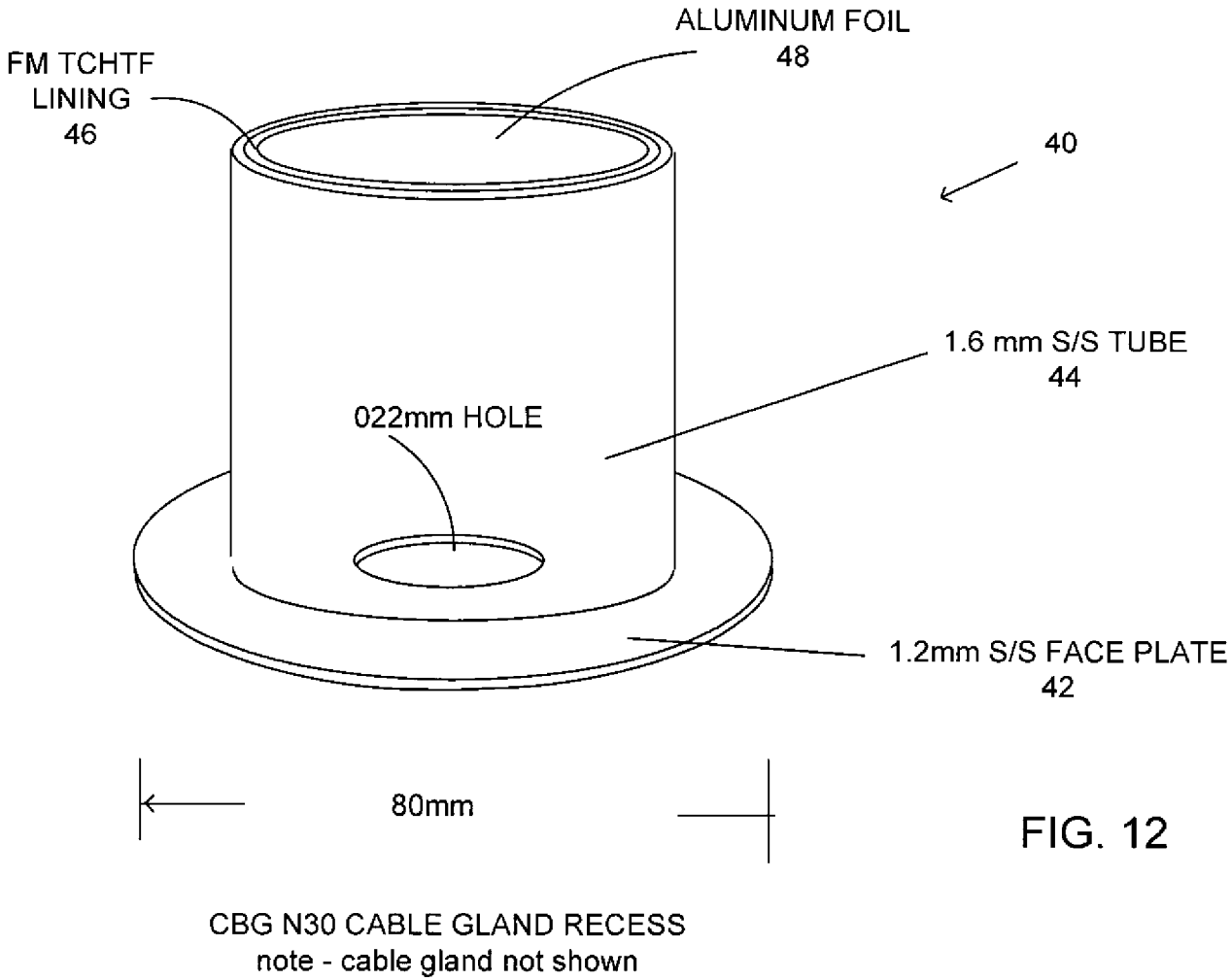
FIG. 12 is a sketch showing a cable gland recess.

The cable gland recess penetration 40 is shown in the FIG. 12 sketch. It is constructed from 50 mm diameter, 1.6 mm wall stainless steel tube 44. A 1.2 stainless steel face plate 42 is welded to the tube, which features a hole in the centre, where a cable gland is installed. Cable glands are typically made from plastic or nickel plated brass, during a hydrocarbon fire event, both of these materials will be subjected to heat which is greater than their melting point. Once the gland has melted away, this would normally enable the heat to pass directly through the penetration. To solve this issue, a 'tube' of TC HTF lining 46 is installed on the inside of the stainless steel tube with an aluminum foil cover 48. The felt will exfoliate/expand upon the application of heat, which will close over any gap inside the stainless steel tube. Once the cable gland has melted away, the space left is filled by the felt, which provides thermal resistance to the heat generated by the fire event.

AFFF Sprinkler Recess Penetration

AFFF (Aqueous Film Forming Foams) are commonly used onboard ships, US Navy and otherwise, as an active fire suppressant, which cool the fire and coat the fuel, preventing its contact with oxygen. The AFFF is usually deployed using sprinklers connected to piped distribution system, and must be installed on the fire side of the panel system, and therefore penetrate the system, in order to be effective. The AFFF sprinkler recess penetration can also be used for other fire suppression devices, such as water, chemical and gas sprinklers.

The AFFF sprinkler recess penetration is constructed from 75 mm diameter, 1.6 mm wall stainless steel tube 50. A 1.2 stainless steel face plate 52 is welded to the tube, which features a hole in the centre, where the sprinkler protrudes. A 0.5±0.05 mm stainless steel end cap is spot welded to the top of the tube, in which the sprinkler is installed at the point where it meets the distribution pipe.

Figure 13:
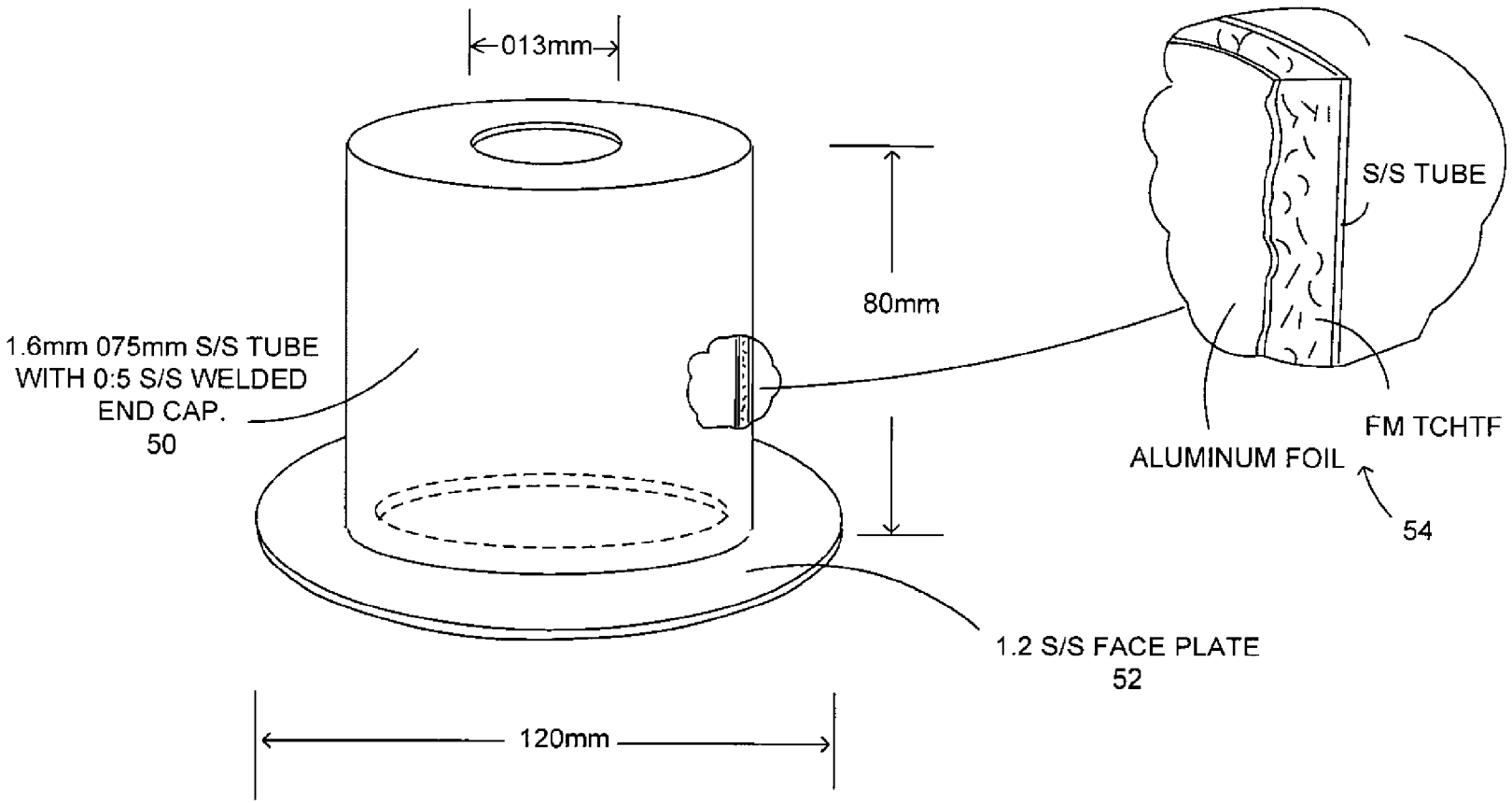
FIG. 13 is a sketch showing a sprinkler recess.

AFFF sprinklers are typically made from brass, during a hydrocarbon fire event, this material will be subjected to heat which is greater than its melting point. Once the sprinkler has melted away, this would normally enable the heat to pass directly through the penetration. As shown in FIG. 13, to solve this issue, a 'tube' of high temperature felt, TC HTF, available from Thermal Ceramics, is installed on the inside of the stainless steel tube as shown at 52 in FIG. 13. The felt will exfoliate/expand upon the application of heat, which will close over any gap inside the stainless steel tube. Once the sprinkler has melted away, the space left is filled by the felt, which provides thermal resistance to the heat generated by the fire event.

Installation Details

The CBG N-30 PS is installed on "stand-off" brackets 57 which are connected to the ships structure 67 (or representation thereof during testing), preferably via the flanges of a T-bar stiffeners 56 as shown in FIG. 6. The stand-off brackets are welded to the structure so that the structural integrity of the ships structure is not compromised, which would be possible if the panel system were mounted directly to the ships structure 67.

Figure 7:
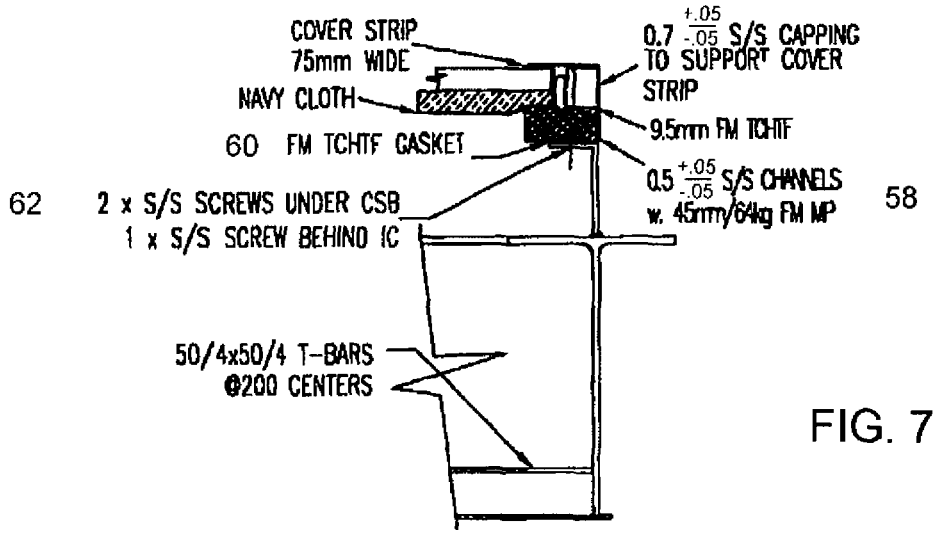
FIG. 7 is a section view (Section C-C) referring FIG. 1 and showing features of the preferred embodiment.

Pre-insulated sub-frame channel 4 is then installed on to the stand-off brackets 57 as shown in FIGS. 6 and 7, but with an optional thin piece of insulation 69 between the aluminium stand-off bracket and stainless steel channel. This layer of insulation provides a thermal break between the panel system and the ships structure, as well as minimizing the corrosion effect when two dissimilar metals are in contact in a marine environment. The channel is fixed to the stand-off brackets with stainless steel self-drilling screws 62, two at the corners where four sections of channel intersect (underneath corner support brackets 6, and one underneath where intermediate clips 8 are installed.

The subframe channel is set out in a rectangular grid, preferably at 1200 mm×900 mm (about 4 foot×3 foot) centres. T-bars are installed in grid of a first set of parallel rows that are spaced 1200 mm apart in a first direction and a second set of parallel rows in a second direction perpendicular to the first direction that are spaced 900 mm apart. The centre points are taken from the centerline of the to-be-added sub-frame channels. Typically, ships are built with 1200 mm (about 4 foot) or 8 foot frames, especially in the case of aluminium ships, a deep set of T-bar stiffeners is built into the ship at these 1200 mm (about 4 foot) spacings. Subframe channel is installed along the centerlines of these T-bars at 1200 mm (about 4 foot) centers, and sections of subframe channel are installed perpendicular to the T-bars are 900 mm (about 3 foot) centers to create a 1200×900 mm grid of sub-frame channels.

Smaller lengths of sub-frame channel may be installed depending on the size/shape of the installation area. The panel system typically follows the contour of the ship, which may involve recessed sections, angles etc, and subframe channel is installed to accommodate these variations from a flat plane.

The CBG N30 panel system requires an air gap between the ships shell plating and the reverse, non-fire side of the insulated panels, allowing room for ships services (fluid transfer, electrical cables, pneumatic/hydraulic systems etc) to be installed behind the panel system. On traditional profile wrap blanket fire protection systems, where insulation blanket is installed directly onto the ships shell plating and stiffeners, these services must be installed on the fire side of the fire protection system. This creates issues for installation as the mounting brackets for these services must penetrate the fire protection blanket, so it can be fixed to the ships structure. Since these blanket systems are rarely, if ever, tested with these bracket penetrations in place, it brings up fire performance concerns, as the real-life configuration is not the same as the 'as tested' configuration. The typical air gap required on the CBG N30 panel system is 300 mm, but can be greater or less, depending on the 'as tested' arrangement and installation requirements. The air gap is maintained by installing various sizes of stand-off brackets, depending on the profile of the installation area. The airgap must be maintained to equal or greater than the 'as tested' air gap arrangement. A greater than the 'as tested' air gap has a positive effect on the performance of the system during a fire event.

At the point where subframe channel intersect, the side sections of the channel are notched out, to a length equivalent to the width of the channel. The bottom sections of the channel are overlapped, and the screws fixing the channel in place to the stand-off brackets penetrate through each section of channel. This overlapping process serves to add strength to the subframe channel grid, which is critical to the performance of the system during a shock event. This process has not been used previously on CBG panel systems, and is a new and unique part of the installation process.

Once the subframe channel is in place, corner support brackets are installed where subframe channel intersects. The corner support brackets are fixed in place with a stainless steel rivet on either side of the bracket. Between corner support brackets, intermediate clips 8 are installed, three between the corner support brackets at 1200 mm/4 foot centers, and two between the corner support brackets at 900 mm/3 foot centers. The intermediate clips are fixed in place with a stainless steel rivet on either side of the clip.

Insulated panels are now fitted into place. Firstly, the locking discs on the corner support brackets are aligned so that the panel can fit into place. The panel is aligned with the tabs on the corner support brackets, these tabs fit into the gaps in each corner of the panel. This ensures the panel is centralized within the respective subframe grid. The locking discs on the corner support brackets at the corners of the panel are turned, so that the panel is temporarily held in place.

Once adjacent panels have been installed, cover strips are now fitted. The cover strip legs fit into the gap between each panel, and are held in place with stainless steel machine screws, which screws into a threaded insert, installed in the intermediate clips. The flange of the cover strip covers the edges of the panels, and creates a tortuous path for fire.

When the cover strips have been installed at the junction of four panels, cover plates are installed. The cover plate has a recess at each corner, in which the cover strip flange tightly fits. The cover plate is held in place with a stainless steel machine screw, which screws into a thread insert, which is installed in the corner support bracket.

Cable Gland Recess Penetration Installation

Cable gland recess penetrations are installed by cutting out the required hole in the panel face, this is typically done with a holesaw. Once the hole is cut, the insulation is cutaway, but leaving enough so there is a tight fit once the cable gland recess penetration is in place. The cable gland recess penetration is now installed, and held in place with rivets which fix the cable gland recess penetration face plate to the panel face. The cable gland is installed into the face plate, through which cables/tubing are installed through.

AFFF Sprinkler Penetration Installation

AFFF sprinkler penetrations are installed by cutting out the required hole in the panel face. This is typically done with a holesaw. Once the hole is cut, the insulation is cutaway, but leaving enough so there is a tight fit once the AFFF sprinkler recess penetration is in place. The AFFF sprinkler penetration is now installed, and held in place with rivets which fix the AFFF sprinkler penetration face plate to the panel face. The AFFF sprinkler is installed into the end cap.

Finishing Angles/Capping

Various finishing angles and capping are typically required to complete and installation. These are fabricated from stainless steel and fitted where required.

Variations

The present invention has been described in terms of a particular embodiment. Persons skilled in the fire damage prevention art will recognize that many changes, variations and additions could be made for other applications of the invention. For example Table I below lists items that are important in preferred embodiments and provides some comments regarding potential variations.

TABLE I

CBG N-30 Panel System Preferred and Variations

| System Part | Preferred | Variation | Notes |
|---|---|---|---|
| Stand-off bracket | Yes | Size and material | Could be made from any metal |
| Stand-off bracket gasket | Yes | Thickness and material | Could be made from any type of insulation |
| Insulated sub-frame channel | Yes | Insulation and material | Insulation could be changed (different material, thickness and/or density), including removal of TC HTF. Material |

TABLE I-continued

CBG N-30 Panel System Preferred and Variations

| System Part | Preferred | Variation | Notes |
|---|---|---|---|
| | | | could be any metal |
| Corner support brackets | Yes | Material | Could be made from any metal |
| Intermediate clips | Yes | Material | Could be made from any metal |
| Insulated panels including | Yes | Insulation and material | Insulation could be changed (different material, thickness and/or density), including only a single layer of insulation with no foil. Could be made from any metal |
| Navy cloth (on back of insulated panel) | No | Material | Not required for fire and shock performance. Could be removed or substituted for any flexible material |
| Cover strips | Yes | Material and dimensions | Could be made from any metal and potentially made wider or thinner |
| Cover plates | Yes | Material and dimensions | Could be made from any metal and potentially made wider or thinner |
| Insulated light panels | Yes | Insulation and material | Insulation could be changed (different material, thickness and/or density), including only a single layer of insulation with no foil. Could be made from any metal |
| Cable gland recess penetration | Yes | Material, insulation and design | Insulation could be changed from TC HTF. Could be made from any metal. Could be designed differently |
| AFFF sprinkler recess penetration | Yes | Material, insulation and design | Insulation could be changed from TC HTF. Could be made from any metal. Could be designed differently. Not only for AFFF sprinklers, but any fire suppression device |
| Finishing angles/flashings | No | Material and design | Could be made from any metal. Design could vary greatly, depending on installation requirements. |

The above described preferred embodiment has been tested with a hydrocarbon fire curve, and has a 10-minute safety margin before reaching fail criteria. When subjected to N-30 fire testing, it achieved over 40 minutes before the relevant fail criteria were reached. In terms of maximum fire intensity, there is no more intense fire test than a rapid rise UL 1709 fire curve. This system could achieve longer fire durations with the simple addition of more insulation.

A major fire would require repair or replacement of the system. The extent would need to be assessed on a case-by-case basis. Typically if there is a fire onboard a ship that is not extinguished by active means (sailor with a fire extinguisher or fixed fire fighting means such as AFFF/Halon/CO2 drenching systems), then it will be quite severe and cause major damage to anything exposed on the fire-side of the N-30 system. IF the fire was very minor and some distance away from the system, did not mar or distort the surface in any way, did NOT set off the expanding felt, then it is possible, after inspection that the system did not require any repairs. In the case of a minor fire, an assessment and certification from the Original Equipment Manufacturer would be required. Repairs could range from replacement of the expanding felt (very minor fire, up to approx. 200 degrees C. at panel, to a complete replacement of panels, cover strips and cover plates and channel insulation, up to approximately 500 degrees C. at panel). As for the insulation that expands with heat, the need for replacement would depend on the level of fire, but such replacement would be an easy process, remove panels (2 minutes per panel) and replace felt insulation (approx. 1 minute per meter), and replace panel (3 minutes per panel).

Any materials substituted for the stainless steel would preferably be steel of some kind since copper/aluminium etc would melt during a fire event. A good candidate is "colorbond", coated and painted zincalume steel. The channel, panels, cover strips, cover plates etc could be made out of this material and the advantage would be lower cost when compared to marine grade stainless steel. Exotic materials such as titanium could be used, which would be lighter and stronger, but significantly more expensive.

Other standard sizes for the panels could be used, for example 1200 mm (4 foot) is a suitable size, since this is typically the span of the main frames of a ship and is suitable from a manual handling perspective. Smaller sizes would be possible e.g. 600 mm (2 foot) but larger would not be preferable. The largest would be 2400 mm×1200 mm (8 foot×4 foot).

For the propeller-shaped dimples, other preferred dimensions are 25 mm long, 3 mm wide and 3 mm deep. Other alternatives could work, but preferably one should not be able to draw a straight line from one edge of the panel to the other without hitting a series of impressions. The reason for this is the linear expansion, as the metal needs somewhere to expand into. Examples of other embossing include a company logo, hexagons, and many various tessellated patterns. The panel sheet is made rigid by embossing a pattern into it, this works in a several ways, it work hardens the metal and also creates small profiles in the section of the metal, similar to curving a piece of paper, it becomes stiff along the axis perpendicular to the curve. Since these profiles are facing in opposite directions all over the panel face, the overall stiffness is increased.

The present invention could be applied to other applications such as tanks and other military vehicles, the embossing could be changed and other penetrations could be used.

Others may attempt to negate the requirement for the expanding felt through a different profile design of the channel/panel/cover strips, a change the metal type, a change the design of the corner support brackets or intermediate clips.

Therefore the scope of the present invention should be determined by the claims that will be provided with the utility application that will follow this provisional application.

What is claimed is:

1. A rapid access fire protection panel system for applications requiring fire protection against severe fire situations, said system comprising:

A) A plurality of standard sized panels adapted for rapid installation and rapid removal for periodic maintenance or inspection, each of said panels comprising:

1) a rigidized metal panel pan comprising a plurality of dimples designed to absorb effects of thermal expansion resulting from extreme heat in order to avoid warping or crumpling of the metal outer layer, 2) a first layer of high density insulation positioned adjacent to said metal outer layer, 3) a second layer of insulation having density of less than one half the density of the first layer, 4) a reflector layer positioned between the first layer and the second layer, 5) a protective cover layer covering the second layer of insulation, B) a stand-off rectangular grid solidly connected to a structure and comprised of insulated sub-frame channel elements configured to support standard sized panels, said sub-frame channel elements being comprised of a generally u-shaped metal channel having within the channel of the channel elements a first channel insulation layer and a second insulation layer within the channel but covering the first insulation layer, said second insulation layer being high density insulation expandable upon the application by at least a factor of four with the application of heat from a hydrocarbon fire, C) a plurality of corner support brackets mounted on said stand-off rectangular grid and adapted to temporarily hold in place said standard sized panels during installation of the panels said corner support brackets being comprised of a locking tab and a locking disk, D) a plurality of generally T-shaped cover strips defining flanges adapted to trap in place said panels between the flanges of said T-shaped cover strips and said insulated sub-frame channels, E) a plurality of intermediate clips solidly attached at intermediate positions on said sub-frame channel elements at positions so as to identify locations for screw mounting said T-shaped cover strips, and F) a plurality of cover plates adapted to be screw mounted on said corner support brackets to cover gaps at intersections of said T-shaped cover strips.

2. The system as in claim 1 and further comprising a plurality of stand-off brackets and a plurality of T-bar brackets positioned to solidly connect said stand-off rectangular grid to said structure.

3. The system as in claim 2 wherein said structure in a portion of a ship.

4. The system as in claim 2 wherein said structure is a deckhead.

5. The system as in claim 2 wherein said structure is a bulkhead.

6. The system as in claim 1 wherein said structure in a portion of a ship.

7. The system as in claim 1 wherein the metal in said rigidized metal panel pans are comprised of stainless steel.

8. The system as in claim 7 wherein the u-shaped metal channels are comprised of stainless steel.

9. The system as in claim 1 wherein said dimples in said rigidized metal panel pans are about 25 millimeters long and about three millimeters deep, are generally propeller-shaped, with a generally circular center defining an approximately 5 millimeter diameter with two arms each pointed and extending in opposite direction for about 10 millimeters, and are spaced at about 25-millimeter centers in a crisscross pattern and adapted to avoid or minimize warping of the layer in the event of a high temperature fire.

10. The system as in claim 1 wherein said dimples in said rigidized metal panel pans are located so that a straight line cannot be drawn from one edge of the panels to an opposite edge without crossing a plurality of said dimples.

11. The system as in claim 1 and further comprising special panels constructed from the same materials as in claim 1 and being adapted to provide a recess region for a light fixture.

12. The system as in claim 1 and further comprising a plurality of cable gland recess penetrations each comprising a tube of high temperature felt lining adapted to expand if subjected to intense heat.

13. The system as in claim 1 and further comprising a plurality of aqueous film forming foam sprinkler recess penetrations, each penetration comprising a tube comprising a high temperature felt lining adapted to expand if subjected to intense heat.

14. The system as in claim 1 wherein said system is constructed so that a single worker can on the average remove and replace the panels at rates better than one panel per four minutes.

* * * * *